United States Patent [19]

Turner

[11] 4,278,520

[45] Jul. 14, 1981

[54] CONTINUOUS GOLD ELECTROPLATING APPARATUS

[75] Inventor: Dennis R. Turner, Chatham Township, Morris County, N.J.

[73] Assignee: Bell Telephone Laboratories, Incorporated, Murray Hill, N.J.

[21] Appl. No.: 64,771

[22] Filed: Aug. 8, 1979

Related U.S. Application Data

[63] Continuation of Ser. No. 911,099, May 31, 1978, abandoned.

[51] Int. Cl.[2] ..... C25D 17/18; C25D 17/28; C25D 5/02

[52] U.S. Cl. ..... 204/207; 204/15; 204/224 R

[58] Field of Search ..... 204/15, 224 R, 28, 206, 204/207

[56] References Cited

U.S. PATENT DOCUMENTS

| | | | |
|---|---|---|---|
| 2,372,599 | 3/1945 | Nachtman | 204/206 |
| 3,657,097 | 4/1972 | Baldock | 204/224 R |
| 3,878,062 | 4/1975 | Grimaldi | 204/15 |
| 4,029,555 | 6/1977 | Tezuka | 204/15 |
| 4,032,414 | 6/1977 | Helder | 204/224 R |
| 4,033,832 | 7/1977 | Sterling | 204/15 |
| 4,083,755 | 4/1978 | Murata | 204/15 |
| 4,153,523 | 5/1979 | Koontz | 204/15 |

*Primary Examiner*—T. M. Tufariello

[57] ABSTRACT

An apparatus and process are described in which a multiple continuous electrochemical procedure is carried out on a metallic strip. Included in this procedure is a gold-plating step with a specially designed gold-plating cell. Also, the gold electroplating is limited to certain areas of the metallic strip where required for a particular application. Particularly important is the design of the various electrochemical processing cells so that continuous processing may be carried out on a continuous moving metal strip. Also, compatibility with other electrochemical and chemical processes carried out on the continuous strip line, is desirable.

10 Claims, 14 Drawing Figures

CONTINUOUS GOLD ELECTROPLATING APPARATUS

This application is a continuation of application Ser. No. 911,099 filed May 31, 1978, now abandoned.

BACKGROUND OF THE INVENTION

The invention involves a gold electroplating procedure and apparatus.

Electrochemical processing procedures are extensively used in modern technology particularly in circuit fabrication and manufacture of electrical devices such as connectors, relay contacts, switch contacts, etc. Bulk processing procedures are often used and usually yield good results. It is desirable to improve these procedures in various ways. More rapid processing is highly desirable for economic reasons, particularly for high volume items. More exact control of the electrochemical process is highly desirable to reduce the number of rejected components and to insure high reliability and long life. Reduced volume of various bath solutions reduces costs of the process.

These considerations are especially true for gold electroplating procedures and apparatus for making high-volume items like pins for connectors. Because high reliability is important, desirable and reduced usage of gold can lead to large savings.

A continuous electrochemical processing apparatus is described by D. E. Koontz and D. R. Turner in U.S. Pat. No. 4,153,523 issued May 8, 1979. It pertains principally to an electrochemical polishing cell useful in a continuous electrochemical processing apparatus.

SUMMARY OF THE INVENTION

The invention is a process and apparatus for continuous gold electroplating on a metallic strip. The apparatus is a succession of processing cells, including cleaning cells, electropolishing cells, rinsing cells and plating cells. These cells are located successively on a strip line plating machine. Processing takes place as the continuous metallic strip moves down the strip line plating machine. Included in the apparatus is a gold electroplating cell. Design of the electroplating cell and electropolishing processing parameters is particularly important so as to insure compatibility with other chemical steps in the continuous electrochemical process. The cell has provision for the metal strip down the center of the structure, an anode (platinum or platinum-coated metal such as platinized titanium) and a slotted section to concentrate the flow of electroplating solution near the anode and area of metal strip where most of the gold plating is desired. Proximity of anode and flow of electroplating solution are used to concentrate gold plating in certain areas of the metal strip.

Although various gold-plating solutions are useful in this apparatus and process, one particular composition is especially suitable because it permits rapid plating with excellent plating results. The plating composition comprises 16–20 gm/l gold as $KAu(CN)_2$, 65 to 85 parts per million cobalt as cobalt citrate and a citrate buffering system with the pH of the solution at approximately 4. The buffering system is conveniently made by adding approximately 100 gm/l citric acid and approximately 50 gm/l KOH to the electroplating solution. The gold electroplating cell may be followed by a blow-off section and often by a rinse cell. Typically, other cells proceed and follow the gold electroplating cell which carry out various electrochemical procedures such as cleaning, electropolishing, etc. One typical arrangement has first a nickel plating cell, then a flash gold-plating cell and then the gold electroplating cell. These various cells may have blow-off sections and rinse cells interposed at various locations along the strip line to minimize contamination between cells.

DETAILED DESCRIPTION

An understanding of the invention can conveniently be obtained by a description of the drawings.

Figure 1:
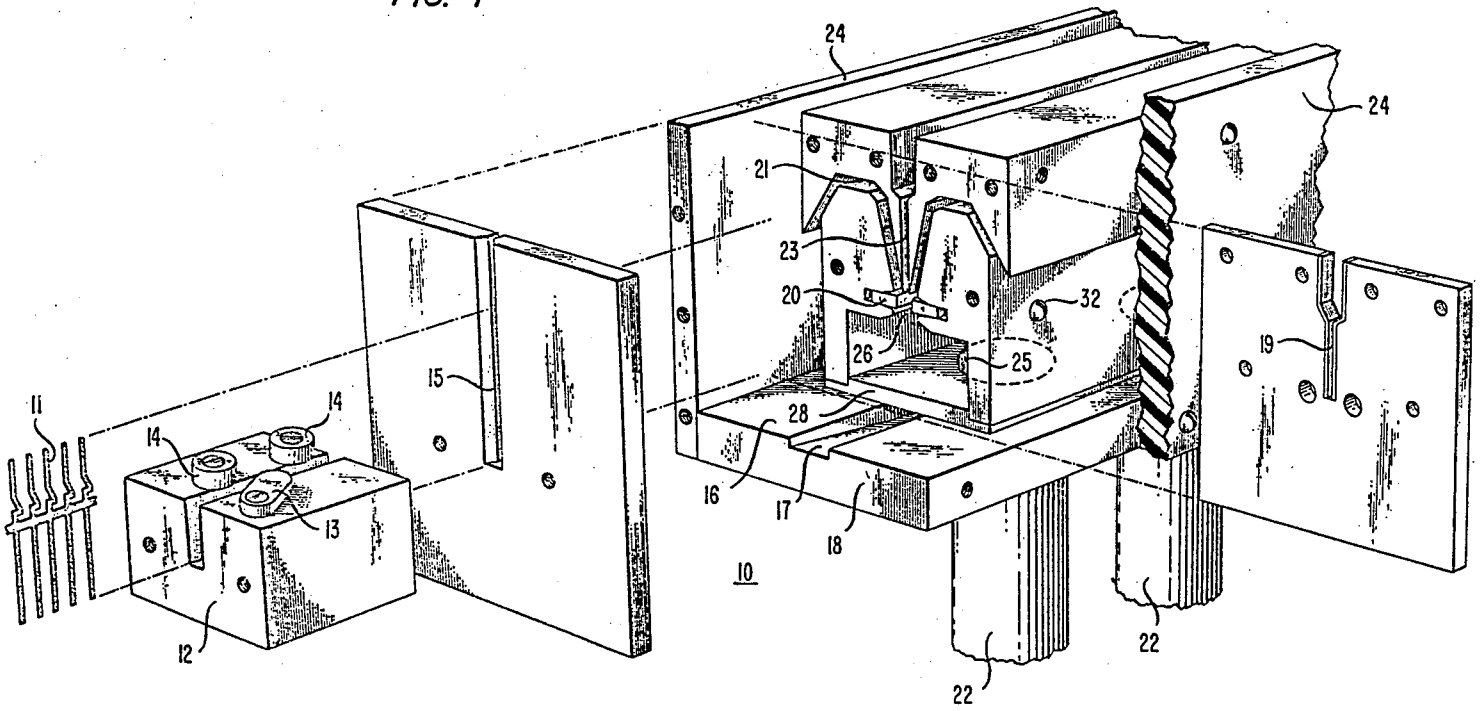
FIG. 1 shows a perspective view partly in section of the gold electroplating cell.

FIG. 1 shows an exploded perspective view of the gold electroplating cell 10 with the metallic strip 11 entering the electrical contact block 12 with spring loaded, rectangular member 13 (rounded off where it makes contact with the metal strip) and two stationary round members 14 located on the opposite side of the metal strip, one before and one after the rectangular member 13 and also pressed against the metal strip.

The metal strip then enters a slotted section 15, deep enough so that the metal strip extends into the gold electroplating cell and in particular so that the part of the metal strip to be gold electroplated extends down to where the anode is located.

The metal strip then goes into a spill-over chamber 16 with a cutaway section 17 on the bottom member 18 to collect gold electroplating solution that has spilled out from the main part of the gold electroplating cell.

The metal strip then enters another slotted section, deep enough to permit the part of the metal strip to be gold electroplated to be adjacent to the anode and wide enough to accommodate the metal strip. Typically, the slotted section is between 1.7 and 2.3 inches long and between 1/16 and ¼ inches wide.

The metal strip then enters the main part of the gold electroplating cell with anode 20 running the length of the cell, passageway for electroplating solution 21 and drain-off tubes 22. A slotted section 23 running down the center of the cell provides a space for the metal strip.

In operation, the gold electroplating solution is pumped up through a tube in the bottom of the cell, up the space between outside wall 24 and inner chamber wall 25, through the solution passageway 21 and down onto the anode area where gold electroplating takes place. Only, the portion of the metal strip in proximity 26 with the anode and the flow of plating solution will receive extensive gold plating. Plating solution drains down to the bottom of the cell and out the drain-off tube to the solution reservoir.

The metal strip exits through another slotted section into a drain-off section with drain tube and through another slotted section and out of the cell.

Figure 2:
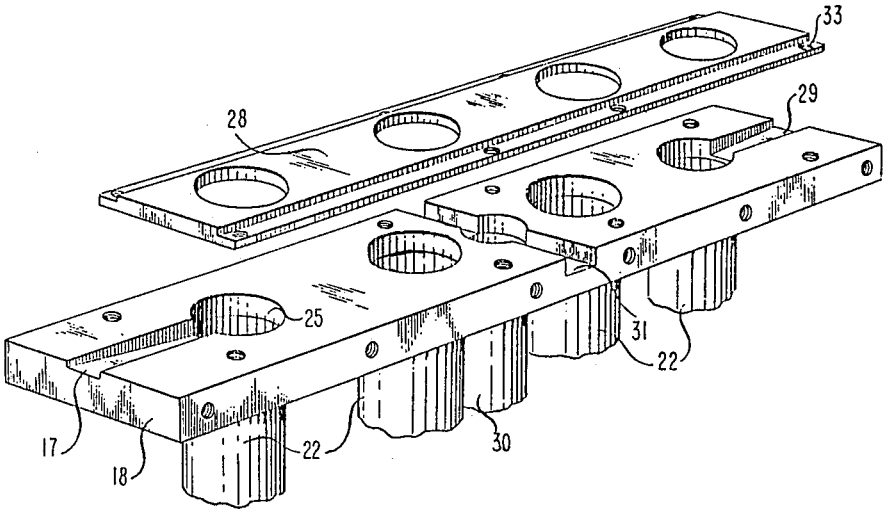
FIG. 2 shows a perspective view of the bottom pieces of the gold electroplating cell.

FIG. 2 shows two of the bottom pieces 27 and 28 with slots 17 and 29 for draining off plating solution in the front and rear drain-off sections and openings for draining plating solution into the reservoir. Solution is pumped up into the cell through a tube 30 and is directed to each side of the cell through a slot and then up the sides of the cell. The upper piece 28 fits onto the bottom piece 27 to cover over each slot 17, 29, 31 and to provide a fitting ridge 33 for the inner pieces of the cell.

Figure 3:
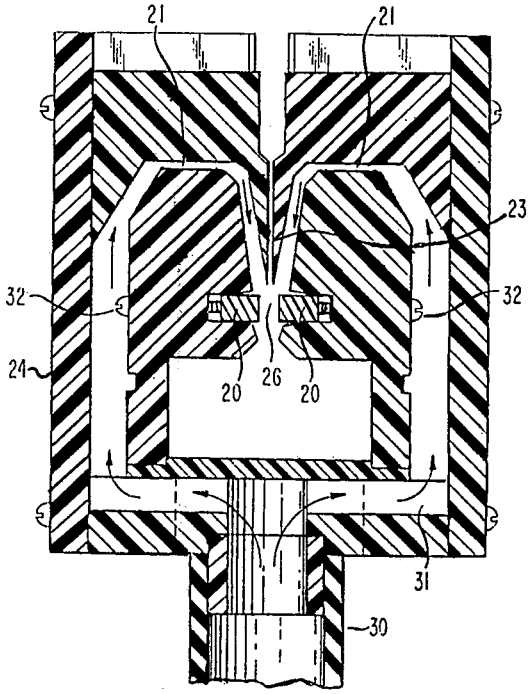
FIG. 3 shows a cross-section of the gold electroplating cell.

FIG. 3 shows a section through the middle of the cell where the input tube 30 is located. Also shown is the slotted section along which the plating solution flows and the channels 21 are used to flow plating solution to the proximity 26 of the anode. Adjustment screws adjust the exact position of the anode. The center slot 23 where the metal strip fits is also shown.

Figure 4:
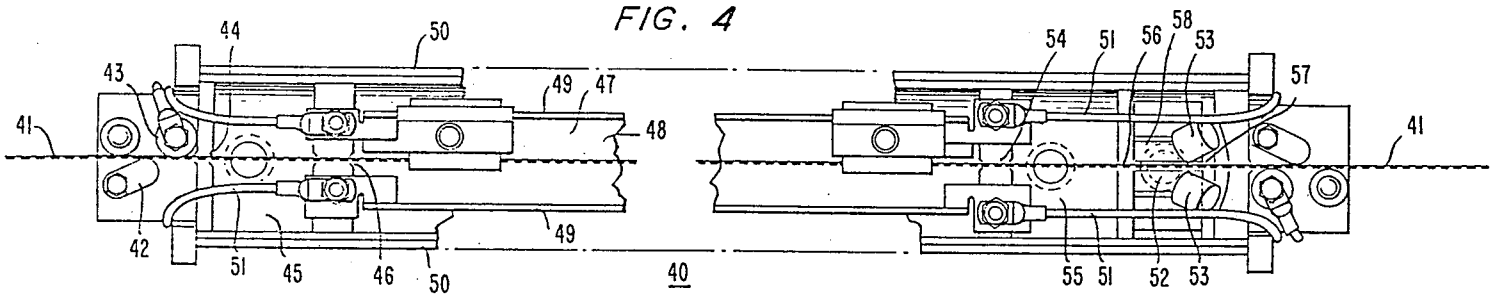
FIG. 4 shows a top view of the electropolishing cell.

FIG. 4 shows a top view of an electropolishing cell 40 comprising generally a long narrow container with metallic strip 41 entering the electropolishing cell through an electrical contact 42 and 43. The electrical contact arrangement comprises a spring loaded member 42 which is pressed up against the strip and two round members 43 located on the other side of the metal strip, before and after the rectangular member and in contact with the metal strip. This electrical contact arrangement is used to pass current between metal strip and one polarity of a power supply. Generally, the entire metal strip is kept at the same potential and the counter electrodes biased either positive or negative for electropolishing or electroplating.

The strip then passes through a small narrow slotted section 44 into a small spill-over chamber 45, then through another small narrow slotted section 46 and into the main part of the electropolishing cell 47 containing the place for electropolishing solution 48 and electrodes 49. These electrodes are in the form of long flat plates extending over most of the length of the cell and parallel to both the strip and cell walls 50. Wires 51 are used to carry electrical energy from power supply to the electrodes. The strip exits the main part of the electropolishing cell through a small narrow slot 54 into a spill-over chamber 55. The metal strip exits the spill-over chamber 55 through another small narrow slot 56. A blow-off section 52 is used to blow off most of the electroplating solution from the strip prior to leaving the cell. Two nozzles 53 are used to direct a gaseous stream (usually air) onto the strip 41 so as to remove electrolyte solution. The metal strip exits through a small opening 57 in the blow-off section and then to subsequent processing cells.

Figure 5:
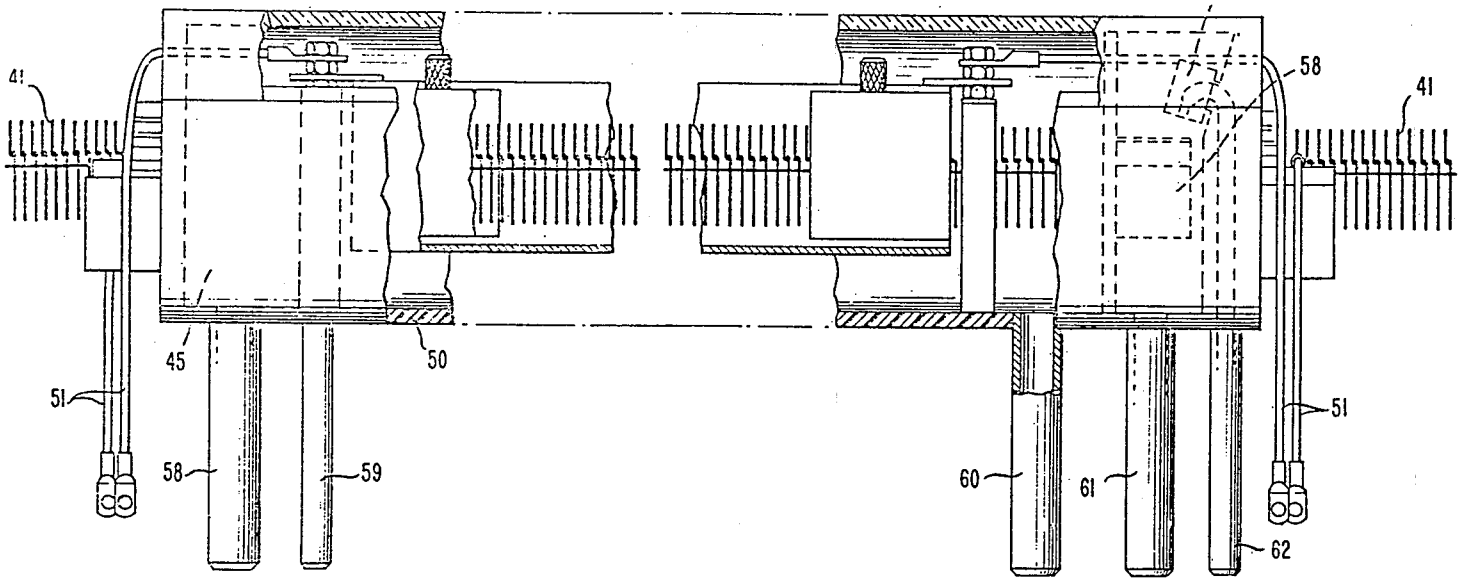
FIG. 5 shows a side view of the electropolishing cell.

FIG. 5 shows a side view of the electropolishing cell 40 showing metal strip 41 and drain-off or exit tube 58 from the spill-over chamber 45 and wires 51 used to carry current to the electrodes 49. The entrance tube 59 for the electropolishing solution is also shown together with electrode 49 and cell wall 50. Also shown is the exit tube 60 for the spill-over chamber 55 and the exit tube 61 for the blow-off chamber 52. The exit tubes (58, 60, 61) convey electropolishing solution to a reservoir from which it is recirculated by pumping electropolishing solution up through the entrance tube 59. The tube 62 is used to convey gas (usually air) for the blow-off nozzle 53.

Figure 6:
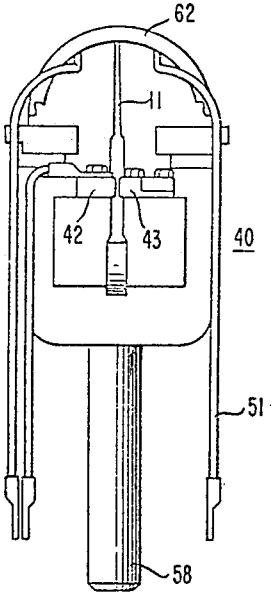
FIG. 6 shows an end view of the entrance end of the electropolishing cell.

FIG. 6 shows an end view of the entrance end of the polishing cell with electrical wires 51 and exit tube 58. Also shown are electrical contacts 42 and 43 and cell cover 62.

Figure 7:
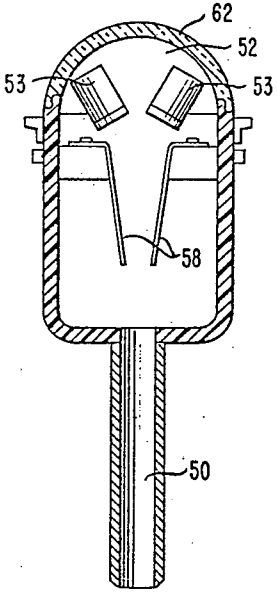
FIG. 7 shows an end view of the blow-off section following the electropolishing cell.

FIG. 7 shows an end view of the blow-off section 52 with blow-off nozzles 53 and deflecting blades 58 used to concentrate the air stream on the metal strip. Also shown is the exit tube 60 and cell cover 62.

Figure 8:
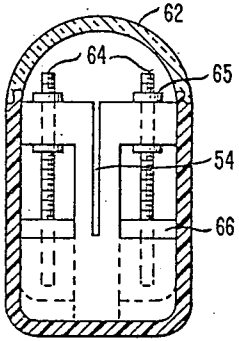
FIG. 8 shows an end view (exit end) of the electropolishing cell including a view of the damming arrangement used to fix the level of electrochemical solution.

FIG. 8 shows an end view of the main part of the electropolishing cell. It includes a small narrow slot 54 through which the metal strip 41 moves. Also shown is a damming device with screws 64, lock nuts 65 and dam 66. The height of this dam controls the level of electropolishing solution in the main part of the electropolishing cell. Electropolishing solution spills over the dam and is returned to a reservoir from which it is subsequently recirculated by pump.

Figure 9:
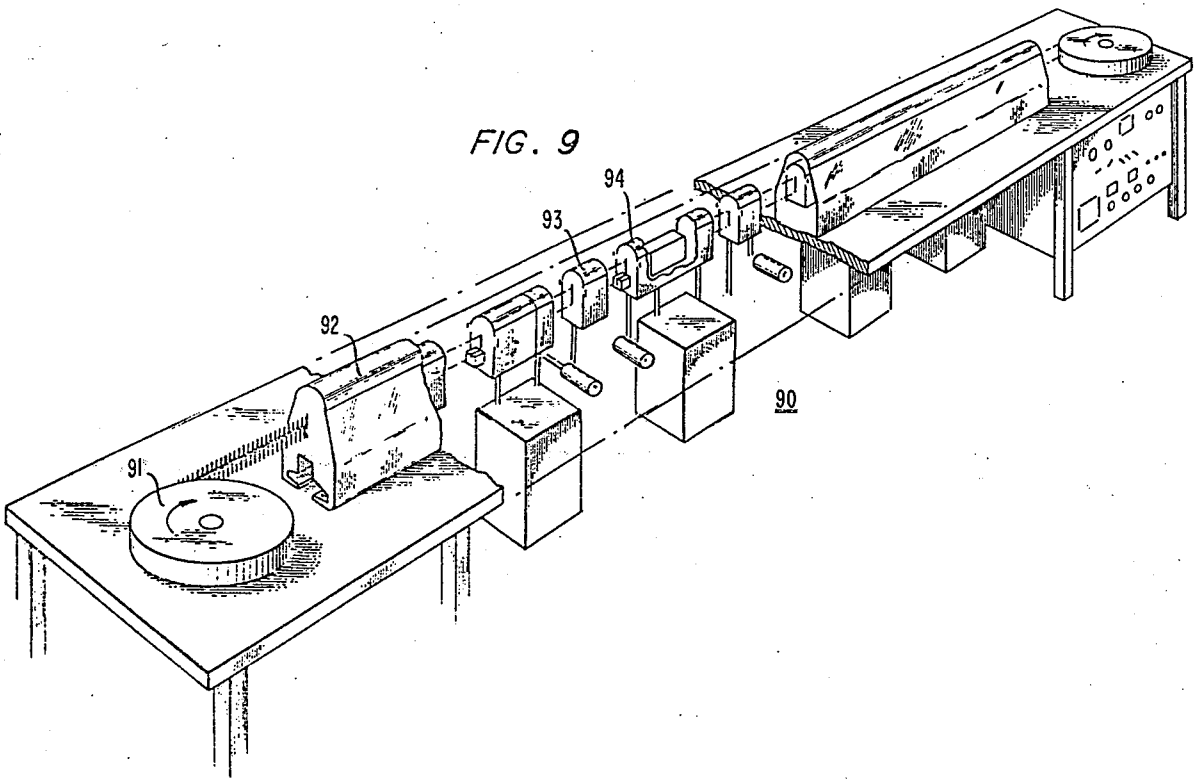
FIG. 9 shows a perspective view of the strip line plating machine.

FIG. 9 shows a perspective view of a strip plating machine 90 with a spool of metal strip 91 which is fed into electropolishing cell 92. Also shown are rinse cells 93 and various plating cells 94.

Figure 10:
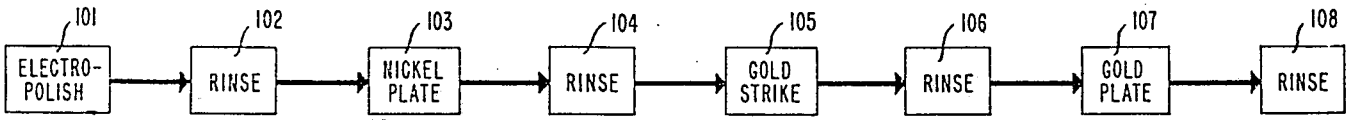
FIG. 10 shows a block diagram of the strip line plating machine.

FIG. 10 shows in block diagram 100 a typical strip line processing apparatus with electropolishing cell 101, rinse cell 102, nickel plating cell 103, rinse cell 104, gold strike cell 105, rinse cell 106, gold plate cell 107 and rinse cell 108.

Figure 11:
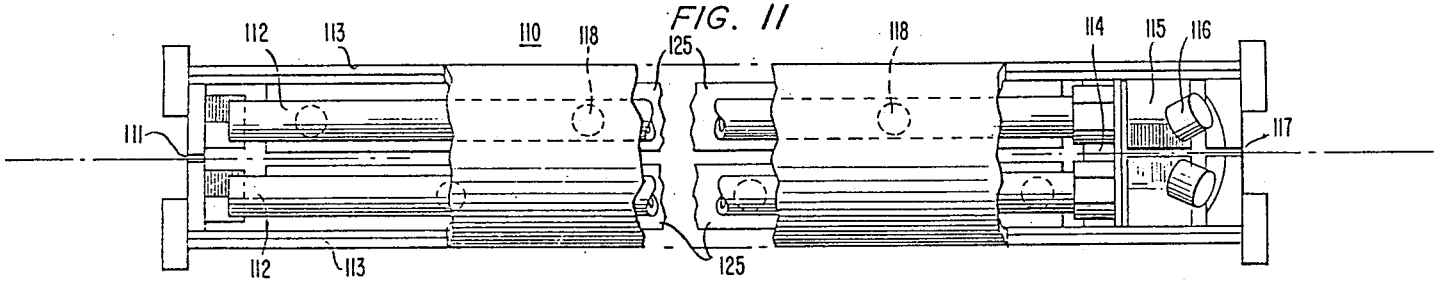
FIG. 11 shows a top view of a rinse cell.

FIG. 11 shows a top view of a rinse cell 110 showing a small narrow slot 111 through which the metal strip enters the rinse cell. Rinsing is provided by a spray of preferably hot water from nozzles 118 attached to tubes 112 running parallel to the cell walls 113. The nozzles 118 are pointed downward toward the metal strips. Although tubes and nozzles may be made of many suitable materials, titanium is preferred for the tube because of rigidity and chemical inertness and chloropolyvinylchloride for the nozzles because of chemical inertness. Parallel walls 125 on either side of the metal strip and displaced parallel to the metal strip are used to concentrate the water spray on the metal strip. The metal strip exits through a small narrow slot into a blow-off section 115 with two nozzles 116 used to direct a gaseous stream (usually air) into the strip line. The metal strip then exits through a small slot 117.

Figure 12:
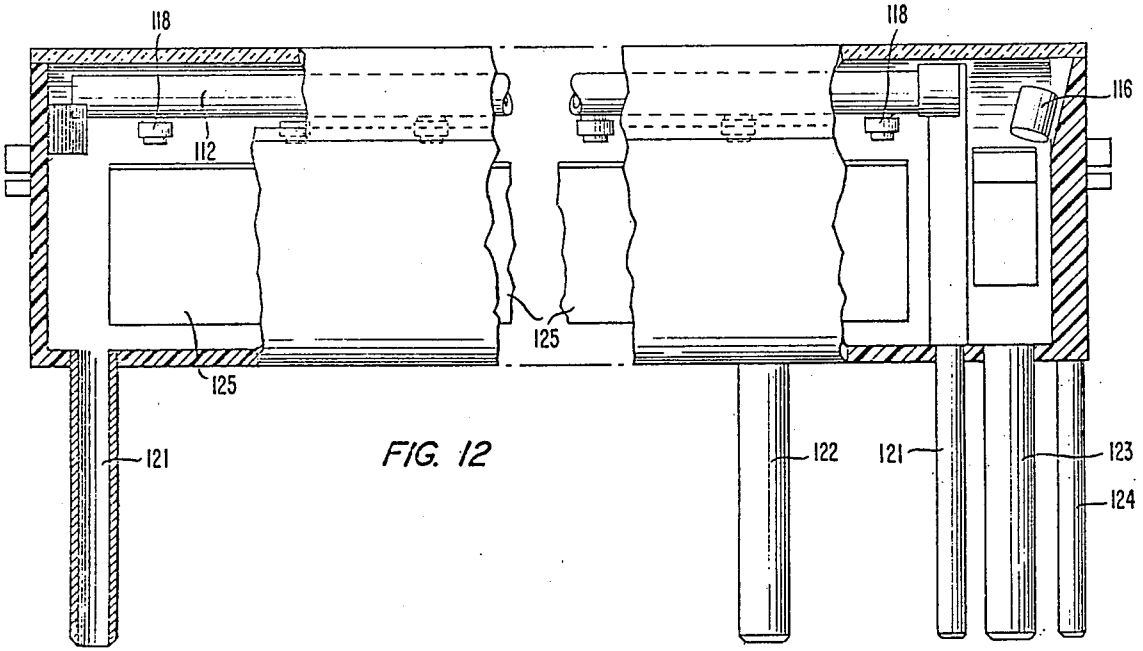
FIG. 12 shows a side view of a rinse cell.

FIG. 12 shows a side view of a rinse cell 110, shown are the tubes used for the water spray 112 and nozzle 116 used for the air spray. Also shown is the water inlet tube 121, water exit tubes 112 and 122 air inlet tube 124 and air-water exit tube 123.

Figure 13:
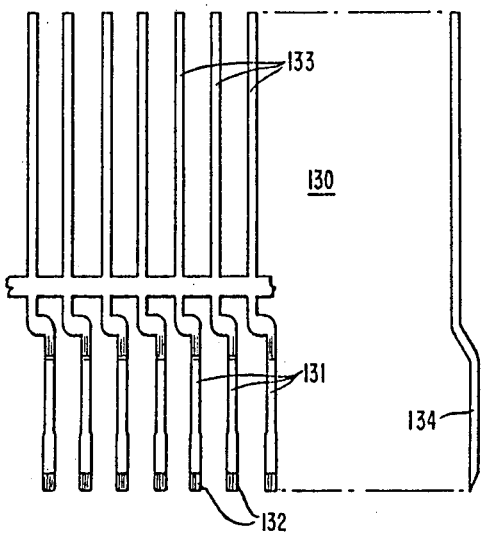
FIG. 13 shows a strip line of connector pins advantageously plated in accordance with the invention.

FIG. 13 shows a portion of the metal strip 130 used to make connector pins 131 with plated portions 132 on the bottom and the plated portions 133 on the top. Also shown is a side view of an individual connector pin 134 made in accordance with the invention.

Figure 14:
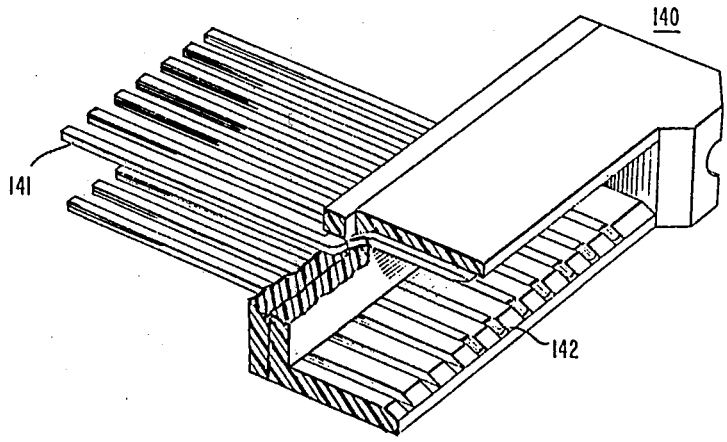
FIG. 14 shows a connector made from pins plated in accordance with the invention.

FIG. 14 shows a cutaway view of a connector 140 with connector pins 141. The figure also shows the portion of the connector pins 142 located inside the connector.

Highly advantageous is a process for making electrical connectors from pins made on the apparatus described above. Pins are required to be exposed to a variety of electrochemical processes including cleaning, electropolishing, different electroplating procedures, such as nickel plating, flash gold plating, hard gold plating, etc. In addition, continuous strips (unpunched) may also be processed. Particularly advantageous is immediate sequential processing since surfaces are not contaminated between processing steps and large amounts of inventory need not be built up between processing steps. Further, pins are rapidly produced, with high yield and low cost. Process control is exceptionally good because rapid recirculating bath solutions can be temperature stabilized easily and rapidly analyzed to insure good compositional control. The process is particularly convenient for real time control, including pH measurement, temperature control, etc., as processing is carried out. It permits many economic advantages such as high speed processing, reduced labor, reduced inventory of chemicals, reduced venting costs, time-shared processing control, common support systems for all processing steps and flexibility in exchanging processing cells for improved processing or adding additional processing steps.

I claim:

1. An apparatus for continuous electrochemical processing on a continuous metallic strip using a plurality of processing steps carried out in a plurality of processing cells including a gold electroplating cell, said gold electroplating cell comprising a long narrow container with provision for the continuous metal strip which is the cathode in the gold electroplating process, provision for gold electroplating solution and anode comprising:

(a) means for making electrical contact to the metallic strip, said means comprising a spring loaded rectangular member rounded-off at the end and pressing against the metal strip line and two stationary round members located on the other side of the strip line and located before and after the spring loaded rectangular member, said rectangular and round members made of conducting material;

(b) a first slotted section for admitting metal strip into an entrance spill-over chamber, said slotted section being deep enough to admit at least a portion of the metal strip into the gold electroplating cell and wide enough to provide clearance for the metal strip;

(c) a first spill-over chamber with a cutaway section to convey gold electroplating solution to a drainage tube leading to a reservoir;

(d) a second slotted section for admitting the metal strip into a main part of the gold electroplating cell said slotted section being deep enough to admit at least a portion of the metal strip into the gold electroplating cell and wide enough to provide clearance for the metal strip;

(e) a main part of the gold electroplating cell comprising a drain-off tube to return the electroplating solution to a reservoir;

(f) a third slotted section for admitting the metal strip into a second spill-over chamber said slotted section being deep enough to admit at least a portion of the metal strip into the gold electroplating processing cell and wide enough to provide clearance for the metal strip; and (g) a fourth slotted section which is deep enough to admit at least a portion of the metal strip into the gold electroplating cell and wide enough to provide clearance for the metal strip, characterized in that (1) the main part of the gold electroplating cell comprising in addition a long slotted section running down the center of the cell in which the metal strip fits, said long slotted section being located on the mirror plane which runs down the length of the main part of the gold electroplating cell; anode comprising long bar and located on each side of the mirror plane and running the length of the main part of the gold electroplating cell; a series of side walls and inner walls which permits electroplating solution to be conveyed from an inner tube, up the side of the cell and down onto the area around the anode and the long slotted section where the metal strip is located.

2. The apparatus of claim 1 in which the slotted section extends beween 1.7 and 2.3 inches below the sides of the long narrow container and is between 1/16 and $\frac{1}{4}$ inches wide.

3. The apparatus of claim 1 in which the metallic strip comprises at least 50 percent by weight copper.

4. The apparatus of claim 3 in which the metallic strip consists essentially of 9 weight percent nickel, 2 weight percent tin, remainder copper.

5. The apparatus of claim 1 in which the electropolishing cell is followed by a rinse cell.

6. The apparatus of claim 5 in which the rinse cell comprises:

(a) an entrance slotted section for admitting the metal strip into the rinse cell, said entrance slotted section being deep enough to admit at least a portion of the metal strip into the rinse cell and wide enough to provide clearance for the metal strip;

(b) two tubes located along the length of the rinse cell and equipped with nozzles so that water sprays towards the place for the metal strip;

(c) deflection plates located on each side of the metal strip, parallel to the length of the metal strip and slightly inclined toward the strip as the deflection plates extend downward so as to concentrate rinse spray onto the metal strip;

(d) a rinse exit slotted section said rinse exit slotted section being deep enough to admit at least a portion of the metal strip into the rinse cell and wide enough to provide clearance for the metal strip; and (e) a blow-off section with gas nozzles used to blow off liquid from the metal strip.

7. The apparatus of claim 6 in which the tubes consist essentially of titanium and the nozzles consist essentially of chloropolyvinylchloride.

8. The apparatus of claim 1 in which the metal strip is taken off a spool at the entrance to the plating apparatus and wound onto a spool at the exit of the apparatus.

9. The apparatus of claim 1 in which the gold electroplating cell is proceeded by a gold strike cell, a nickel plating cell, and an electropolishing cell in an entirely closed system.

10. The apparatus of claim 1 in which the metal strip comprises connector pins for an electrical connector.

* * * * *